US010314374B2

(12) United States Patent
Yu

(10) Patent No.: US 10,314,374 B2
(45) Date of Patent: Jun. 11, 2019

(54) LUGGAGE WITH HIDDEN STORAGE COMPARTMENT WITHIN EXPANDABLE AREA

(71) Applicant: Olympia International, Inc., Torrance, CA (US)

(72) Inventor: Chris Yu, Torrance, CA (US)

(73) Assignee: Olympia International, Inc., Torrance, CA (US)

( * ) Notice: Subject to any disclaimer, the term of this patent is extended or adjusted under 35 U.S.C. 154(b) by 207 days.

(21) Appl. No.: 15/243,677

(22) Filed: Aug. 22, 2016

(65) Prior Publication Data

US 2017/0290398 A1 Oct. 12, 2017

(30) Foreign Application Priority Data

Apr. 12, 2016 (CN) ..... 2016 2 0300468 U

(51) Int. Cl.

| | |
|---|---|
| ***A45C 13/00*** | (2006.01) |
| ***A45C 7/00*** | (2006.01) |
| ***A45C 5/03*** | (2006.01) |
| ***A45C 5/06*** | (2006.01) |
| ***A45C 5/14*** | (2006.01) |
| ***A45C 13/10*** | (2006.01) |
| ***A45C 13/26*** | (2006.01) |

(52) U.S. Cl.

CPC ..... *A45C 7/0027* (2013.01); *A45C 5/03* (2013.01); *A45C 5/06* (2013.01); *A45C 5/14* (2013.01); *A45C 13/103* (2013.01); *A45C 13/262* (2013.01); *A45C 2013/267* (2013.01)

(58) Field of Classification Search

CPC ..... A45C 7/0027; A45C 5/03; A45C 5/06; A45C 5/14; A45C 13/103; A45C 13/262; A45C 2013/267

See application file for complete search history.

(56) References Cited

U.S. PATENT DOCUMENTS 2,170,841 A * 8/1939 Thies ..... A45C 7/0059 383/15
4,236,615 A * 12/1980 Ginat ..... A45C 7/0068 190/103

(Continued)

FOREIGN PATENT DOCUMENTS

| | | |
|---|---|---|
| JP | 2013000236 | 1/2013 |
| WO | 2014097337 | 6/2014 |

OTHER PUBLICATIONS

Korean Intellectual Property Office Application Serial No. 20-2016-0004452, Office Action dated Aug. 11, 2017, 2 pages.

*Primary Examiner* — Tri M Mai

(74) *Attorney, Agent, or Firm* — Lee, Hong, Degerman, Kang & Waimey

(57) ABSTRACT

A luggage container includes: a main compartment; a cover portion coupled to the main compartment and configured to be open or closed via a first opening/closing mechanism element to expose or cover the main compartment; an expandable portion extendingly coupled to the main compartment, the expandable portion comprising a second opening/closing mechanism element; and a storage compartment comprising an opening portion formed at the expandable portion and a pocket portion extending from the opening portion such that the pocket portion of the storage compartment is located in the main compartment.

16 Claims, 4 Drawing Sheets

(56) References Cited

U.S. PATENT DOCUMENTS

| | | | | | |
|---|---|---|---|---|---|
| 5,042,664 | A * | 8/1991 | Shyr | A45C 3/00 | 190/109 |
| 5,143,188 | A * | 9/1992 | Robinet | A45C 3/00 | 150/117 |
| 5,427,453 | A * | 6/1995 | Cloessner | A45C 3/00 | 190/109 |
| 6,237,764 | B1 * | 5/2001 | Kastelic | A45C 3/00 | 190/103 |
| 7,232,018 | B1 * | 6/2007 | Salander | A45C 5/14 | 190/103 |
| 9,119,448 | B1 * | 9/2015 | Hirshberg | A45C 7/0077 | |
| 2006/0102673 | A1 * | 5/2006 | Collier | A45C 7/0068 | 224/581 |

* cited by examiner

LUGGAGE WITH HIDDEN STORAGE COMPARTMENT WITHIN EXPANDABLE AREA

CROSS-REFERENCE TO RELATED APPLICATIONS

Pursuant to 35 U.S.C. § 119(a), this application claims the benefit of earlier filing date and right of priority to Chinese Application No. 201620300468.7 filed on Apr. 12, 2016.

BACKGROUND OF THE INVENTION

Field

The present invention relates generally to luggage containers. More specifically, the present invention relates to an expandable luggage that has an expandable portion with a concealable storage compartment formed at the expandable portion. The storage compartment is concealed when the expandable portion is not expanded and an opening of the storage compartment is exposed when the expandable portion is expanded.

Background

A challenge to traveling has always been carrying one's belongings in the most efficient and easy manner. To meet this challenge, expandable luggage designs have appeared in the prior art to allow carrying additional items when expanded. However, prior art designs merely allow expansion of a portion of the luggage without providing any other functions or uses of the expanded portion. Items, such as a personal laptop computer or notebook, must be taken out of a luggage to go through a security check point at an airport. However, it is very inconvenient to take out such items from the luggage because the luggage may need to be open completely if such items are stored within a main storage space of the luggage. Even if a notebook may be stored in an outer compartment of the luggage for each access, for example, in an outer compartment formed at an opening/closing cover of the luggage, the notebook in the outer compartment may be susceptible to impacts because the notebook is located at or near an outermost portion of the luggage. Therefore, a solution is necessary to avoid such inconvenience and to minimize impacts applied to an item stored in the luggage.

SUMMARY OF THE INVENTION

Accordingly, the present invention is directed to an improved luggage apparatus that substantially obviates one or more of the problems due to limitations and disadvantages of the related art. According to one embodiment of the present invention, a luggage container includes a main compartment having a front side and a backside; a cover portion coupled to the main compartment to cover the front side of the main compartment and configured to be open or closed via a first opening/closing mechanism element to expose or cover the main compartment; an expandable portion extendingly coupled to the main compartment, the expandable portion including a second opening/closing mechanism element; and a storage compartment including an opening portion formed at the expandable portion and a pocket portion extending from the opening portion such that the pocket portion of the storage compartment is located in the main compartment.

In one aspect of the present invention, the expandable portion is configured to be in a closed configuration when the second opening/closing mechanism element is closed and to be in an expanded configuration when the second opening/closing mechanism element is open. In another aspect of the present invention, the opening portion of the storage compartment is concealed when the expandable portion is in the closed configuration and exposed when the expandable portion is in the expanded configuration. In yet another aspect of the present invention, the opening portion includes a third opening/closing mechanism element and the opening portion is not visible in the main compartment while the outer surface of the pocket portion is visible in the main compartment such that the inner surface of the pocket portion is visible via the opening portion.

According to another embodiment of the present invention, a bag includes: a main compartment including a front side, a backside, and an opening; an expandable portion extendingly formed at the main compartment, the expandable portion including an opening/closing mechanism element; and a storage compartment including an opening portion formed at the expandable portion and a pocket portion extending from the opening portion such that the pocket portion of the storage compartment is located in the main compartment, wherein: the expandable portion is configured to be in a closed configuration when the opening/closing mechanism element is closed and to be in an expanded configuration when the opening/closing mechanism element is open; and the opening portion of the storage compartment is concealed when the expandable portion is in the closed configuration and exposed when the expandable portion is in the expanded configuration.

In one aspect, the opening portion includes a first zipper track configured to open or close the opening portion according to movement of a first slider. In another aspect, the main compartment further includes a second zipper track configured to open or close the opening according to movement of a second slider.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF EMBODIMENTS

Hereinafter, the present invention will be described with respect to the embodiment(s) illustrated in the annexed drawings.

Figure 1A:
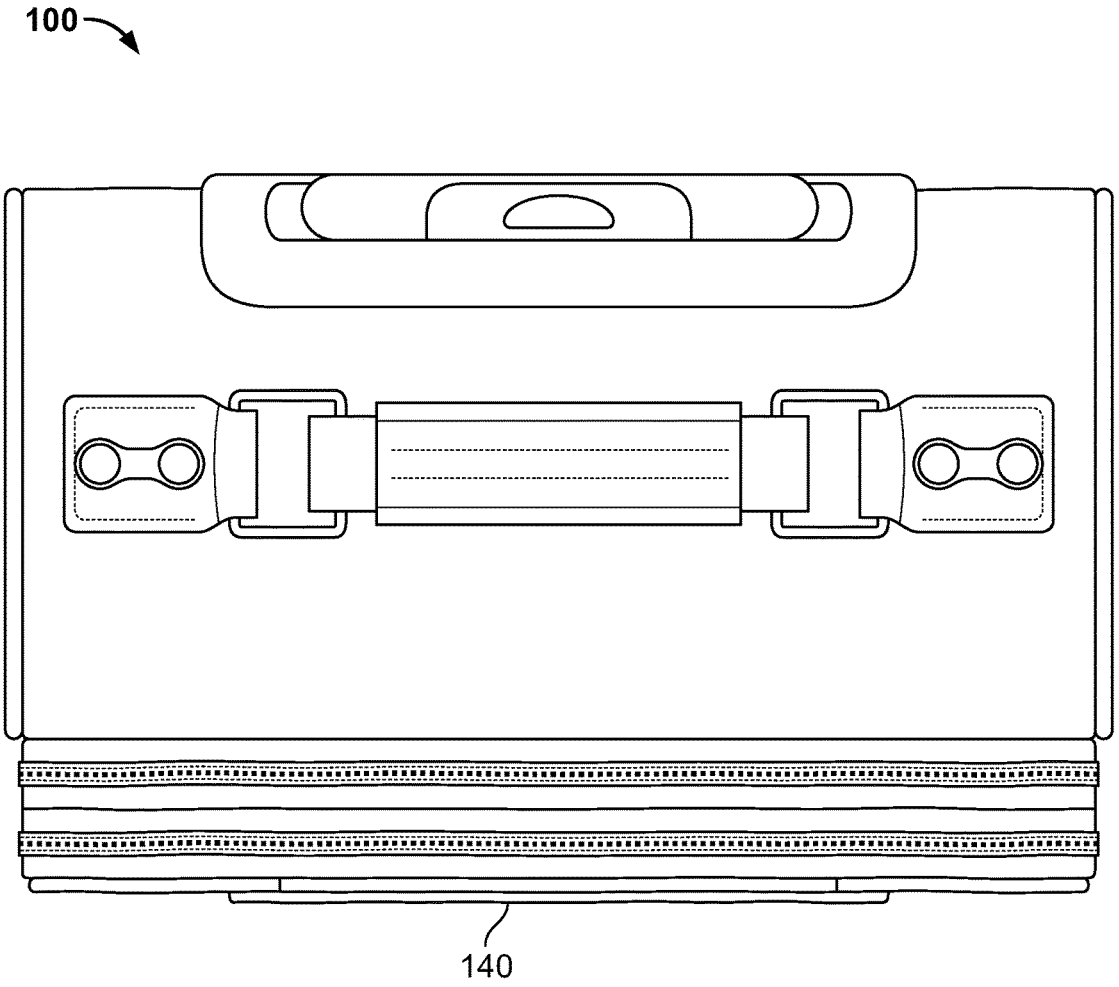
FIG. 1A is a top plan view of a luggage in which an expandable portion is in a closed configuration according to an embodiment of the present invention.
Figure 1B:
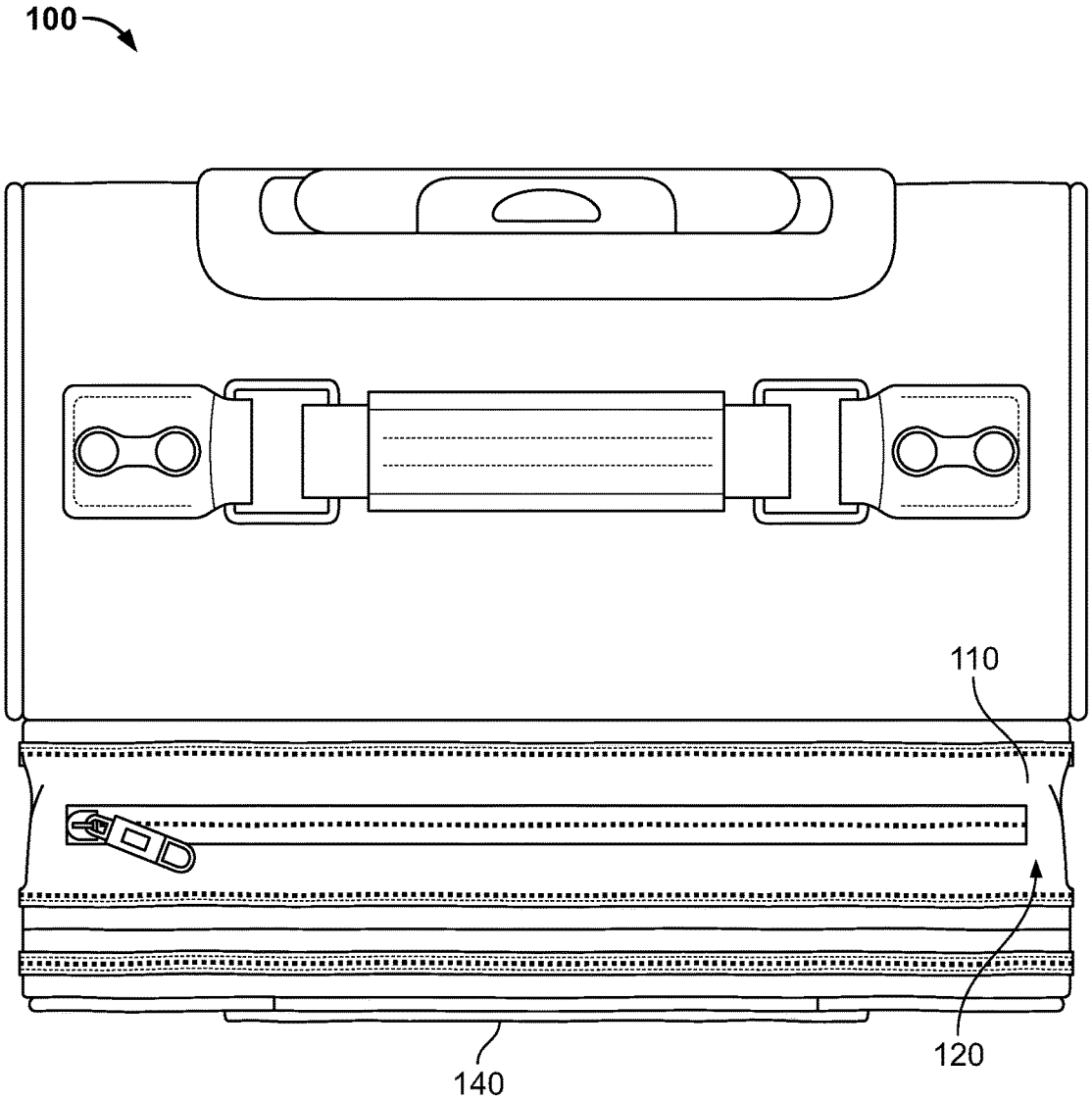
FIG. 1B is a top plan view of a luggage in which an expandable portion is in an expanded configuration according to an embodiment of the present invention.

Referring to FIG. 1A and FIG. 1B, when an expandable portion 110 of a luggage 100 is switched from a closed configuration, as shown in FIG. 1A, to an expanded configuration, as shown in FIG. 1B, an opening 120 of a storage compartment 130 is exposed. In one embodiment, the storage compartment 130 is made of mesh fabric. In another embodiment, the storage compartment 130 is made of a substantially transparent material.

Although, FIG. 1A and FIG. 1B show that the opening 120 is formed at a top portion of the expandable portion 110 to receive an item to be stored from the top in a vertical direction, an opening may be formed at a side portion of the expandable portion 110 to receive an item to be stored from the side in a horizontal direction. In contrast, in conventional expandable luggage containers, merely an expandable portion that does not have any other structures formed thereon is exposed when the luggage is expanded.

For example, according to an embodiment of the present invention, the expandable portion 110 is formed at or near a front side portion of the luggage 100, as shown in FIG. 1A and FIG. 1B, such that the expandable portion 110 is located adjacent to a cover portion 140 of the luggage 100 that is used to open/close the luggage 100. Alternatively, although not shown in drawings, the expandable portion 110 may be formed at or near a middle portion or a back side portion of the luggage 100. Further, multiple expandable portions may be formed at a plurality of portions of the luggage 100, at least one of the multiple expandable portions having a storage compartment formed therethrough.

According to an embodiment, switching between the closed configuration and the expanded configuration is achieved by manipulation of an opening/closing mechanism element formed at the expandable portion 110. For example, the opening/closing mechanism element includes a zipper having zipper tracks and one or two slider(s) holding the zipper tracks together, as shown in FIG. 1A. The luggage 100 is in the expanded configuration as shown in FIG. 1B when the zipper is unzipped by sliding the slider(s). For example, when there are two sliders for the opening, the expandable portion 110 is expanded when the two sliders are slid away from one another. When the luggage 100 is in the expanded configuration, a width of the luggage 100 increases compared to a width of the luggage 100 in the closed configuration, thus increasing a storage space inside the luggage. For example, the width of the luggage 100 may be increased by at least 5 centimeter (cm), about 10 cm, or more than 10 cm when the luggage 100 is in the expanded configuration.

In one embodiment, as shown in FIG. 1A and FIG. 1B, the opening 120 of the storage compartment 130, which is concealed when the luggage 100 is in the closed configuration and exposed when the luggage 100 is in the expanded configuration, includes an opening/closing mechanism element. For example, the opening/closing mechanism of the opening 120 is a zipper. When the zipper of the opening 120 is open, the storage compartment 130 is configured to receive an item, thus allowing receiving the item into the storage compartment 130 via the opening 120. The opening 120 may be exposed even if the expandable portion 110 is not fully expanded. That is, for example, the zipper of the expandable portion 110 may not be unzipped fully and may be unzipped partially to a certain degree to merely expose the opening 120 of the storage compartment 130. Such a structure of the expandable portion 110 allows easy access to the opening 120 of the storage compartment 130, thus allowing quick and convenient storage of an item such as a notebook computer in the storage compartment 130 without requiring opening of the entire luggage 100.

Once the item is stored in the storage compartment 130, the expandable portion 110 may remain in the expanded configuration or the expandable portion 110 may be closed after the item is stored in the storage compartment 130 such that the luggage 100 with the item stored in the storage compartment 130 may be carried in the closed configuration. The item may be taken out of the storage compartment 130 easily by opening the expandable portion 110, if the expandable portion 110 is closed, and then opening the opening 120 without requiring opening of the entire luggage 100.

According to an alternative embodiment, the opening 120 of the storage compartment 130 may not have an opening/closing mechanism element contrary to the exemplary embodiment shown in FIG. 1B. That is, the storage compartment 130 may have an opening that is always open. Nevertheless, such an opening of the storage compartment 130 will not be exposed externally when the opening/closing mechanism element formed at the expandable portion 110 is manipulated to the closed configuration. Thus, the opening/closing mechanism element may be optional for the storage compartment 130.

Referring to FIG. 1A, FIG. 1B, FIG. 2A, and FIG. 2B, according to an embodiment, since the expandable portion 110 is formed next to or near the cover portion 140, the item stored in the storage compartment 130 may be protected from a direct impact because the cover portion 140 that forms an outer surface of the luggage 100 will act as a shock absorber. In one embodiment, an additional storage compartment may be formed on the cover portion 140.

Figure 2A:
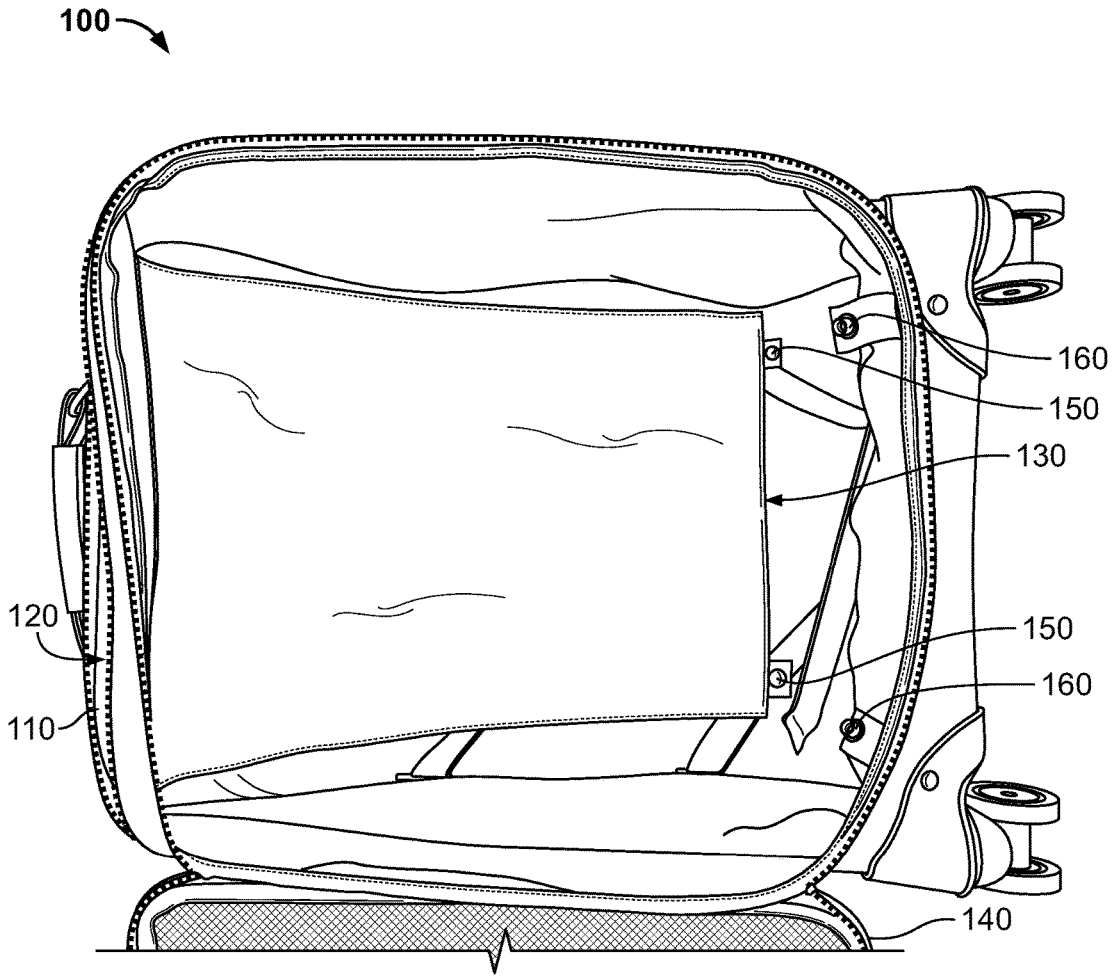
FIG. 2A is a perspective view of a luggage with a concealable storage compartment at a main storage area of the luggage according to an embodiment of the present invention.
Figure 2B:
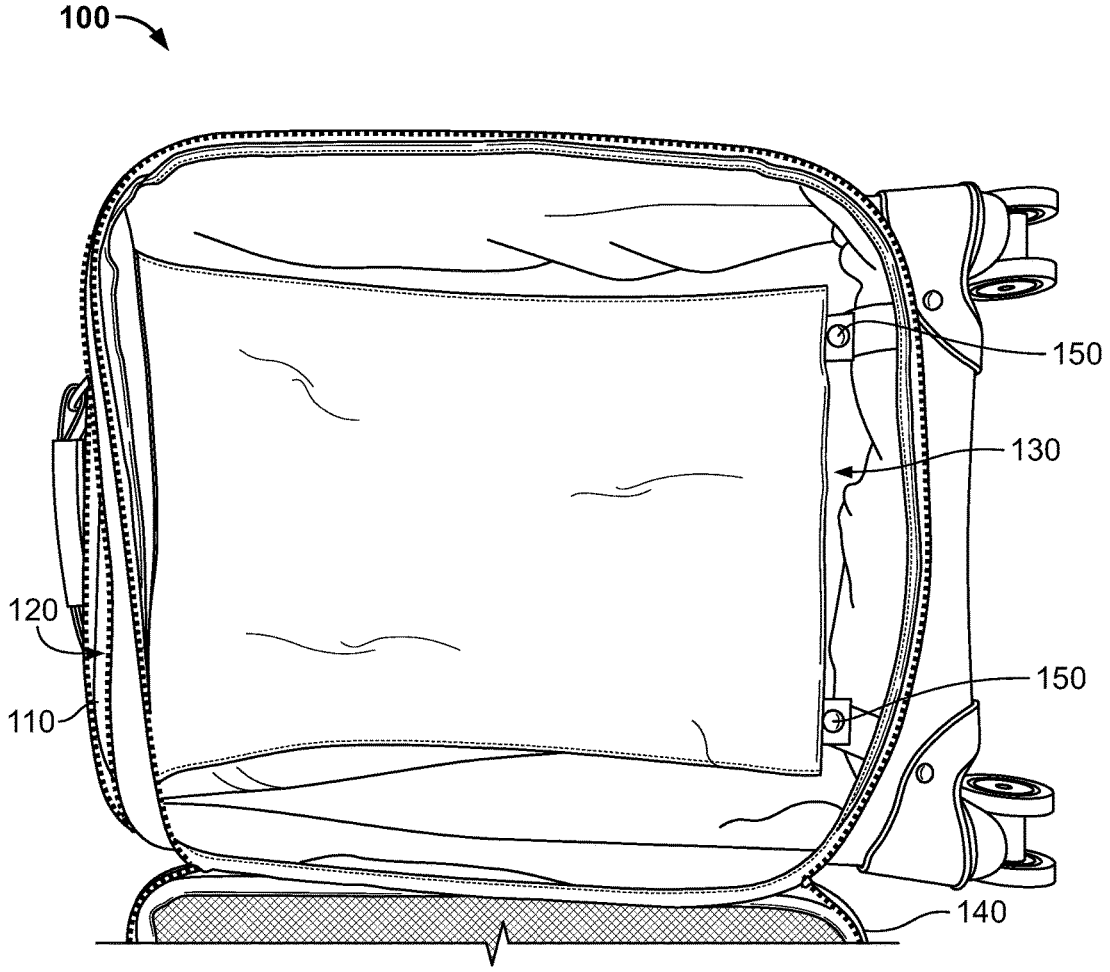
FIG. 2B is a perspective view of the luggage in which the storage compartment is attached to receiving portions according to an embodiment of the present invention.

For example, as shown in FIG. 2A and FIG. 2B, the storage compartment 130 is formed such that the storage compartment 130 is configured to be on a top portion of a storage space of the luggage 100 when the cover portion 140 is open. That is, when the storage space of the luggage 100 is filled with item(s), the storage compartment 130 may be placed on top of the item(s) that are in the storage space. For example, the cover portion 140 and the storage compartment 130 are separated by a distance that is less than 5 cm, 4 cm, 3 cm, 2 cm, or 1 cm although the distance may be more than 5 cm depending on a design of the luggage 100. In one embodiment, the storage compartment 130 may be in contact with an inner surface of the cover portion 140 when the main storage compartment is full of stored items.

Although the storage compartment 130 may be formed to be any sizes, according to an embodiment, the storage compartment 130 is sized to cover substantially the entire area of the storage space such that the storage compartment 130 is placed on top of items stored in the storage space, thus the storage compartment 130 covering the store items. See FIG. 2A and FIG. 2B. According to another embodiment, the storage compartment 130 may be sized to fit a specific item such as a notebook computer or tablet device and some of the items stored in the storage space may be visible around edges of the storage compartment 130 when the cover portion 140 is open.

According to an embodiment, the storage compartment 130 is formed as a pocket. That is, the storage compartment 130 may be formed by joining at least two layers of material together such that the storage compartment 130 appears as a flat layer when no item is stored in the storage compartment 130. For example, the storage compartment 130 may be formed by stitching perimeters of two layers of material except for the perimeter at a side of the opening 120. At the opening 120, one zipper track is formed at a top perimeter of one of the two layers of material and another zipper track is formed at a top perimeter of the other one of the two layers of material such that the opening 120 may be open or closed by sliding at least one slider holding the zipper tracks. However, instead of the zipper tracks and the at least one slider, different types of opening/closing mechanism elements may be used for the opening 120. Furthermore, as mentioned above, the storage compartment 130 may be formed as a pocket that does not have any opening/closing mechanism elements formed at the opening 120.

In one embodiment, an item may be put into the storage compartment 130 only via the opening 120 that is accessible when the expandable portion 110 is open or expanded. In another embodiment, although not shown in the drawings, the storage compartment 130 may have an additional opening that is accessible via inside the luggage 100 when the cover portion 140 is open. For example, a zipper opening may be formed at a portion of the storage compartment 130 that is inside the main storage compartment.

Referring to FIG. 2A and FIG. 2B, in one embodiment, at least one first fastening structure 150 is formed at or attached to the storage compartment 130. For example, the at least one first fastening structure 150 is formed at or attached to an edge portion of the storage compartment 130 that is located at an opposite side of the opening 120. Further, at least one second fastening structure 160 is formed at or attached to an inside portion of the luggage 100. For example, the at least one second fastening structure 160 is formed at or attached to a bottom portion of the luggage 100 that is located at an opposite side of the opening 120. Thus, when the at least one first fastening structure 150 and the at least one second fastening structure 160 are coupled to one another, as shown in FIG. 2B, the position of the storage compartment 130 is fixed such that the storage compartment 130 is laid substantially flat on a top portion of the storing space inside the luggage 100. In an embodiment, hook and loop fasteners may be used instead of the first and second fastening structures 150, 160. In alternative embodiments, any fastener can be used including buttons, additional zippers, snaps or the like instead of the first and second fastening structures 150, 160.

Moreover, instead of or in addition to the at least one second fastening structure 160, at least one third fastening structure may be formed near the top portion of the storage compartment 130. (Not shown in drawings.) In one embodiment, the at least one first fastening structure and the at least one third fastening structure are coupled to one another by folding the storage compartment 130 such that a size of the storage compartment 130 is reduced by about a half. The reduced sized storage compartment 130 may allow easier access to an item stored in the folded storage compartment 130 because a depth of the storage compartment 130 is reduced compared to a depth of the storage compartment 130 that is in an unfolded state. For example, for a small item such as a mini tablet device that is stored in the storage compartment 130, if the storage compartment 130 is in the unfolded state, a user may be able to get the small item by reaching further into the storage compartment 130, requiring placing the user's arm in the storage compartment 130. However, if the storage compartment 130 is folded, the user may reach the stored small item more easily by simply reaching by a hand without placing the arm in the storage compartment 130.

Thus, the storage compartment of the expandable portion describe above, as exemplified in the drawings, would provide not only convenience to a user, but also provide a protective measure for an item that is stored in the storage compartment that is formed at the expandable portion.

Those skilled in the art will appreciate that alternative embodiments exist from the above description of the embodiments without departing from the spirit and scope of the invention. The above described embodiments were shown in the context of a standard carry-on size luggage in the drawings. However, in alternative embodiments, a full size luggage or a luggage with additional compartments can be substituted for the described luggage. In addition, luggage may be made with any material that is suitable. The luggage described herein may be of any sizes and for example, the luggage includes wheeled or non-wheeled luggage, soft or hard side luggage, a trunk, a suitcase, a garment bag, a tote, a duffle back, a backpack, and any types of bags.

Therefore, the foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the composition of the invention. Since many embodiments of the invention can be made without departing from the spirit and scope of the invention, the invention resides in the claims hereinafter appended.

What is claimed is:

1. A luggage container comprising:

a main compartment having a front side and a backside;

a cover portion coupled to the main compartment to cover the front side of the main compartment and configured to be open or closed via a first opening/closing mechanism element to expose or cover the main compartment;

an expandable portion extendingly coupled to the main compartment, the expandable portion comprising a second opening/closing mechanism element; and a storage compartment comprising an opening portion formed at the expandable portion and a pocket portion extending from the opening portion such that the pocket portion of the storage compartment is located in the main compartment, wherein:

the expandable portion is configured to be in a closed configuration when the second opening/closing mechanism element is closed and to be in an expanded configuration when the second opening/closing mechanism element is open;

the opening portion of the storage compartment is concealed when the expandable portion is in the closed configuration and exposed when the expandable portion is in the expanded configuration;

the opening portion of the storage compartment is formed at a top portion of the expandable portion;

the pocket portion of the storage compartment is sized to extend from the top portion of the expandable portion toward a bottom portion of the main compartment such that a bottom portion of the pocket portion contacts or is positioned near the bottom portion of the main compartment when the pocket portion is in an unfolded state;

the pocket portion comprises at least one first fastening structure formed at or attached to an area near the bottom portion of the pocket portion;

at least one second fastening structure is formed at or attached to the bottom portion of the main compartment; and the at least one first fastening structure and the at least one second fastening structure are configured to be coupled to one another to fix a position of the pocket portion at the main compartment when the pocket portion is in the unfolded state.

2. The luggage container of claim 1, wherein when the position of the pocket portion is fixed, the pocket portion is located near the front side of the main compartment such that the pocket portion is close to the cover portion when the cover portion is closed, thus allowing storing of a maximum amount of contents between the pocket portion and the backside of the main compartment.

3. The luggage container of claim 1, wherein:

at least one third fastening structure is formed near the top portion of the pocket portion; and the at least one first fastening structure and the at least one third fastening structure are configured to be coupled to one another when the pocket portion is in a folded state, a size of the pocket portion being reduced by about a half when the pocket portion is converted from the unfolded state to the folded state.

4. The luggage container of claim 1, wherein the storage compartment is sized to receive a laptop or notebook computer or a tablet device.

5. The luggage container of claim 1, wherein the luggage container is a carry-on luggage with wheels and a telescoping handle.

6. The luggage container of claim 1, wherein the first opening/closing mechanism element comprises a first zipper and the second opening/closing mechanism element comprises a second zipper.

7. The luggage container of claim 6, wherein the opening portion comprises a third opening/closing mechanism element and the opening portion is not visible in the main compartment.

8. The luggage container of claim 7, wherein the third opening/closing mechanism element comprises a third zipper.

9. The luggage container of claim 8, wherein the third zipper is exposed externally when the second zipper is at least partially open.

10. The luggage container of claim 1, wherein the opening portion does not have any opening/closing mechanism elements such that the opening portion is always open.

11. The luggage container of claim 1, wherein the storage compartment is made of mesh fabric.

12. The luggage container of claim 1, wherein the luggage container is a wheeled suitcase.

13. A bag comprising:

a main compartment comprising a front side, a backside, and an opening;

an expandable portion extendingly formed at the main compartment, the expandable portion comprising an opening/closing mechanism element; and a storage compartment comprising an opening portion formed at the expandable portion and a pocket portion extending from the opening portion such that the pocket portion of the storage compartment is located in the main compartment, wherein:

the expandable portion is configured to be in a closed configuration when the opening/closing mechanism element is closed and to be in an expanded configuration when the opening/closing mechanism element is open;

the opening portion of the storage compartment is concealed when the expandable portion is in the closed configuration and exposed when the expandable portion is in the expanded configuration;

the opening portion of the storage compartment is formed at a top portion of the expandable portion;

the pocket portion of the storage compartment is sized to extend from the top portion of the expandable portion toward a bottom portion of the main compartment such that a bottom portion of the pocket portion contacts or is positioned near the bottom portion of the main compartment when the pocket portion is in an unfolded state;

the pocket portion comprises at least one first fastening structure formed at or attached to an area near the bottom portion of the pocket portion;

at least one second fastening structure is formed at or attached to the bottom portion of the main compartment; and the at least one first fastening structure and the at least one second fastening structure are configured to be coupled to one another to fix a position of the pocket portion at the main compartment when the pocket portion is in the unfolded state.

14. The bag of claim 13, wherein the opening portion comprises a first zipper track configured to open or close the opening portion according to movement of a first slider.

15. The bag of claim 14, wherein the main compartment further comprises a second zipper track configured to open or close the opening according to movement of a second slider.

16. The luggage container of claim 1, wherein:

an external surface area of the luggage container is increased when the expandable portion is in the expanded configuration, allowing access to the storage compartment via the opening portion exposed in the expandable configuration; and a size of an inner space of the luggage container is increased when the expandable portion is in the expanded configuration, causing increase of a packing capacity.

* * * * *